United States Patent [19]

Bidoia

[11] Patent Number: 4,961,544

[45] Date of Patent: Oct. 9, 1990

[54] CABLE TENSIONER WITH A WINDING DRUM FOR A SKI BOOT

[75] Inventor: Vincenzo Bidoia, Castelfranco/Vento, Italy

[73] Assignee: Lange International S. A., Switzerland

[21] Appl. No.: 410,321

[22] Filed: Sep. 20, 1989

[30] Foreign Application Priority Data

Nov. 9, 1988 [CH] Switzerland ..... 4163/88

[51] Int. Cl.[5] ..... A43B 5/04; A43C 11/00; B65H 75/48

[52] U.S. Cl. ..... 242/54 R; 36/50; 36/119; 24/68 SK

[58] Field of Search ..... 242/54 R, 96, 99, 100, 242/100.1; 254/22, 23; 24/68 SK; 36/50

[56] References Cited

U.S. PATENT DOCUMENTS 4,796,829 1/1989 Pozzobon et al. ..... 36/50 X
4,799,297 1/1989 Baggio et al. ..... 24/68 SK X
4,841,649 6/1989 Baggio et al. ..... 24/68 SK X

FOREIGN PATENT DOCUMENTS 2341658 8/1973 Fed. Rep. of Germany .

*Primary Examiner*—John M. Jillions
*Assistant Examiner*—Yolanda B. Harris
*Attorney, Agent, or Firm*—Kane, Dalsimer, Sullivan, Kurucz, Levy, Eisele & Richard

[57] ABSTRACT

A cable tensioner comprising a winding drum (2) driveable in rotation by means of a handle (12) by the agency of a pinion (10) meshing with a gear wheel (7). The pinion (10) forms part of a non-return device (13, 14). Pressure on the handle (12) releases the drum of the non-return device. According to another embodiment, the non-return device is composed of a worm gear and the drum is released by shifting this.

8 Claims, 3 Drawing Sheets

FIG. 3
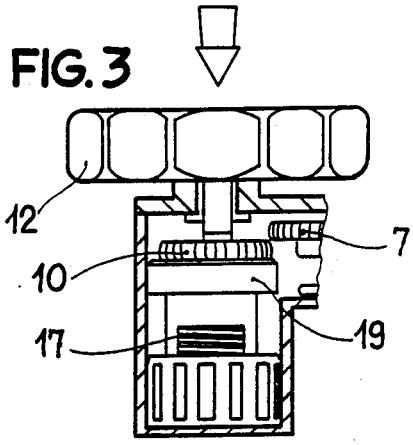
FIG. 1
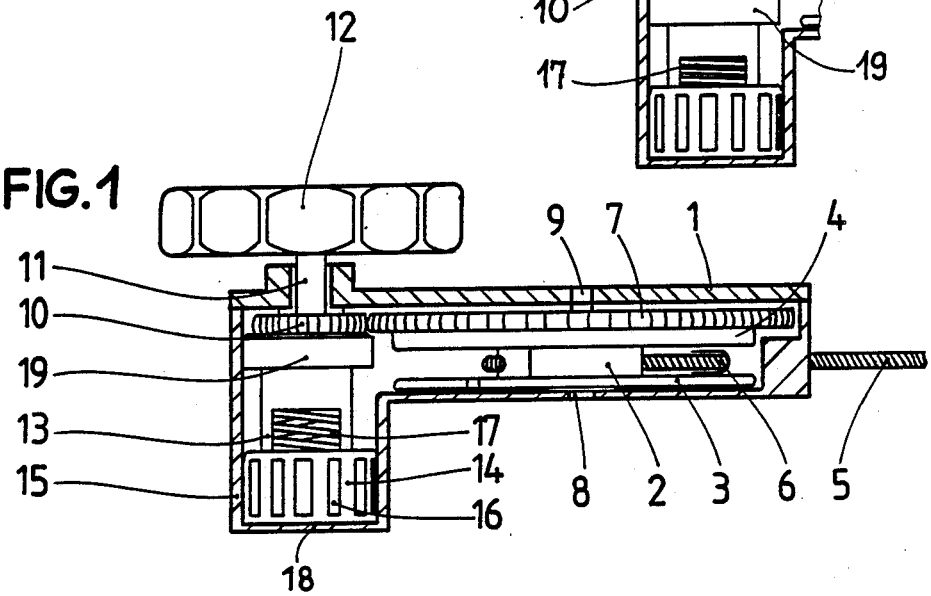
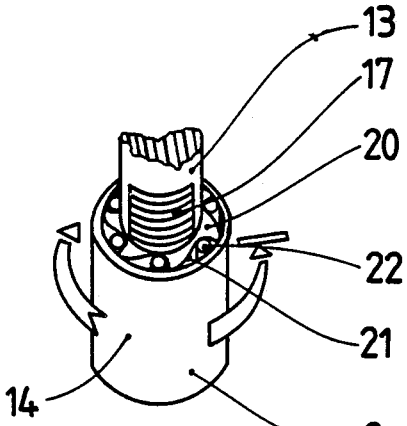
FIG. 2
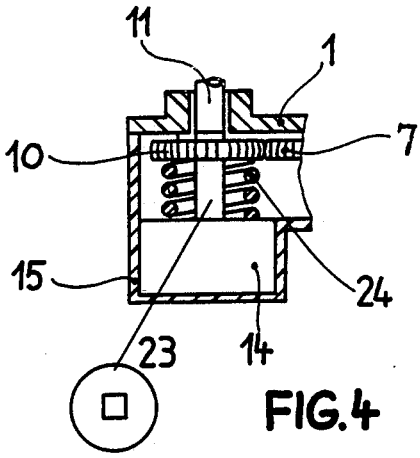
FIG. 4

CABLE TENSIONER WITH A WINDING DRUM FOR A SKI BOOT

FIELD OF THE INVENTION

The subject of the present invention is a cable tensioner with a winding drum for a ski boot, comprising, in a housing, a winding drum equipped with a toothing and driveable in rotation by means of an external handle, and a non-return device preventing the drum from rotating in the unwinding direction, this non-return device being cancellable as a result of action on the handle.

PRIOR ART

A tensioner of this type is described in Patent Application No. DE-2,341,658. This tensioner comprises a winder equipped with a non-return device composed of a ratchet wheel shiftable axially together with the drum counter to the action of a spring and thereby capable of being freed from the pawl as a result of axial pressure on the handle of the tensioner. The direct drive of the drum requires a control knob of relatively large diameter and therefore bulky, and nevertheless it can be difficult for the cable to be tensioned sufficiently.

A tensioner equipped with a non-return device is also described in Patent Application No. EP-0,056,953. In this tensioner, the non-return device is composed of a hub equipped with a flange having an edge toothing interacting with a pawl mounted on a spring. This pawl can be pushed back by rotating the handle in the anticlockwise direction, as a result of a special mounting of the handle on the hub. This tensioner is composed of a large number of components and its non-return device can be released only by hand as a result of a rotational movement of the handle.

A device of very simple construction is described in Patent Application No. DE-2,900,077. The drum is fixed to a star wheel rotating eccentrically and rolling inside a stationary toothing, the assembly as a whole forming an eccentric self-locking gear. There is no provision for releasing the drum quickly.

The object of the present invention is to provide a cable tensioner with a winding drum of the type described above, that is to say of which the drum can be released immediately simply as a result of pressure on the handle, but in which the drum can easily be driven in rotation by using one of the elements of the non-return device.

SUMMARY OF THE INVENTION

The cable tensioner with a winding drum according to the invention is defined in that the cancellable non-return device is composed of a set of movable elements, one of which meshes with the toothing of the winding drum, one of these movable elements being driveable in rotation from outside for the purpose of driving the winding drum.

The non-return device is always active, but it can be uncoupled from the toothing of the winding drum in order to release this. The cancellation of the non-return device, that is to say the release of the drum, is carried out simply as a result of pressure on the handle.

The non-return device can be composed of any known device, for example a one-way coupling with balls or rollers or with a pawl, or of a gear of the irreversible reduction type, such as a helical gear wheel interacting with a worm.

BRIEF DESCRIPTION OF THE DRAWINGS

The accompanying drawing illustrates three embodiments of the invention by way of example.

FIG. 1 is a sectional view of a tensioner according to a first embodiment.

FIG. 2 is a perspective view of the non-return device of the tensioner illustrated in FIG. 1.

FIG. 3 is a partial view, similar to that of FIG. 1, showing the tensioner in the position of release of the winding drum.

FIG. 4 is a partial sectional view of a second embodiment.

FIG. 5 illustrates an example of the use of the tensioners shown in FIGS. 1 to 4 on a boot.

DESCRIPTION OF THE PREFERRED EMBODIMENTS

Figure 6:
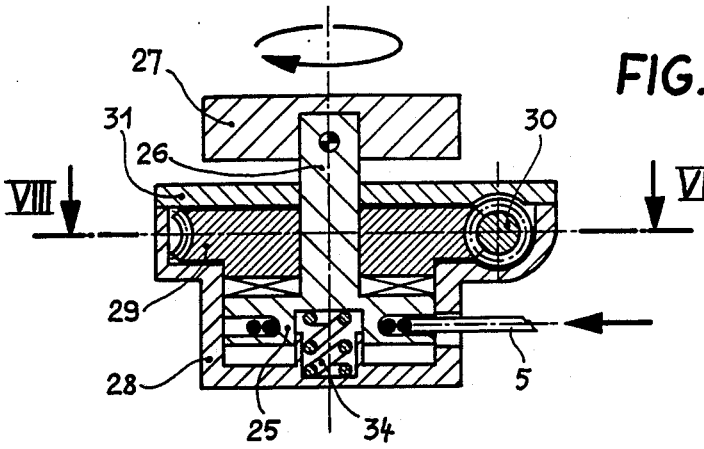
FIG. 6 is a sectional view of a tensioner according to a third embodiment along the line VII—VII of FIG. 7.
Figure 8:
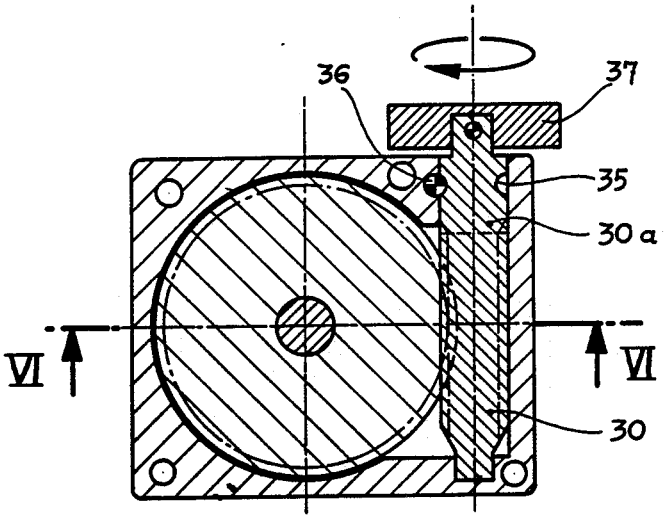
FIG. 8 is a sectional view along the line VI—VI of FIG. 6.

The tensioner illustrated in FIG. 1 takes the form of a rectangular housing 1, made of metal or a synthetic material, in which is mounted a drum 2 which is equipped with two flanges 3 and 4 and onto which is attached the end of a cable 5 passing through the housing 1 via a hole 6. The upper flange 4 of the drum 2 is laid against a gear wheel 7. The drum 2 and the gear wheel 7 can be produced in one piece. The assembly as a whole is equipped with two pivots 8 and 9 engaged in the wall of the housing 1. The gear wheel meshes with the pinion 10 fixed to an axle 11 passing through the housing 1 and fastened to a handle 12 for the purpose of driving the pinion 10. The pinion 10 is extended by a cylindrical part 13 prolonging the axle 1 coaxially and forming one of the elements of a one-way coupling device, the other element 14 of which is fastened to the bottom of a cylindrical protuberance 15 on the housing 1. For this purpose, the element 14 is equipped externally with longitudinal grooves 16 allowing it to be fixed in terms of rotation by crimping or molding on. The element 13 is movable axially together with the pinion 10 and the handle 12. It is retained in the high position by a spring 17 working under compression in an axial recess of the element 13, between the bottom of this recess and the bottom 18 of the cylindrical protuberance 15. The element 13 is guided in its movement by a cylindrical shoulder 19.

The one-way coupling device can be produced in any known way. FIG. 2 shows, by way of example, a one-way coupling device, in which the element 13 is equipped with teeth 20 defining receptacles 21 in which rollers 22 are seated. Such a device is well known per se. The toothing 20 can be cut in the element 13 and axially movable together with this element or, on the contrary, cut in an axially stationary cylinder, in which can slide the element 13 made integral in terms of rotation by means of at least one spline.

When the handle 12 is rotated in the clockwise direction, the pinion 10 drives the gear wheel 7 and consequently the drum 2 onto which the cable 5 is wound. The drum 2 cannot rotate in the unwinding direction because it is retained by the pinion 10, itself prevented from rotating in the other direction by the non-return device 13/14.

However, the drum can be released instantaneously as a result of pressure on the handle 12, as shown in FIG. 3. The teeth of the pinion 10 come out of the teeth of the gear wheel 7. As soon as pressure on the handle 12 is relaxed, the pinion 10 meshes with the gear wheel 7 once again and the gear wheel 7 is once more retained in the unwinding direction. It is therefore possible to relax the tension of the cable 5 partially as a result of brief pressure on the handle 12.

The winding and rotational driving or disengaging functions are separate both mechanically and in spatial terms. This makes it possible to have a slim housing for the drum 2 and the gear wheel 7, which gear wheel can have a relatively large diameter in relation to the pinion 10, so that there can be a high reduction of the drive torque of the pinion 10, thus making it possible to have a handle 12 of small diameter and small thickness, that is to say of reduced bulk on the outside of the boot.

Many alternative versions are possible, not only as regards the type of non-return device, as already mentioned above, but also in the arrangement of the spring and the choice of the axially movable components. FIG. 4 shows a second embodiment by way of example. Most of the components of this second embodiment are the same as in the first embodiment and have been designated by the same references. Only what differs from the first embodiment will therefore be described. The axle 11 is extended below the pinion 10 by a part 23 of square cross-section sliding in the central element of a one-way coupling device, similar to that shown in FIG. 2, and consequently integral in terms of rotation with this central element. A spring 24 working under compression is mounted between the pinion 10 and the central element of the one-way coupling device. This spring can bear directly on this central element or on a cover closing the one-way coupling device. To release the drum 2, pressure is likewise exerted on the handle 12, the effect of this being to free the pinion 10 from the gear wheel 7.

A third embodiment will be described by reference to FIGS. 6 to 9.

The cable tensioner according to this third embodiment comprises a winding drum 25 coaxial relative to and produced in one piece with an axle 26, to the end of which a handle 27 is fastened. The winding drum 25 is seated in a bowl-shaped housing 28, and its axle 26 passes through a helical gear wheel 29 meshing with a worm 30 extending in the plane of the wheel 29. The housing 28 is closed by means of a cover 31. The upper face of the winding drum 25 is equipped with an edge toothing 32 having ratchet teeth. This toothing meshes with a complementary toothing 33 formed on the lower face of the wheel 29. The winding drum 25 is retained against the helical gear wheel 29 by means of a spring 34 working under compression between the bottom of the housing 28 and the bottom of a central recess of the winding drum 25. The worm 30 has a non-threaded part **30*a* equipped with an annular slot 35, into which engages a pin 36 locking the worm 30 axially, whilst allowing it to rotate. One of the ends of the worm 30 projects from the housing 28 and is itself equipped with a knob 37 knurled or splined for the purpose of driving the worm 30**.

Figure 7:
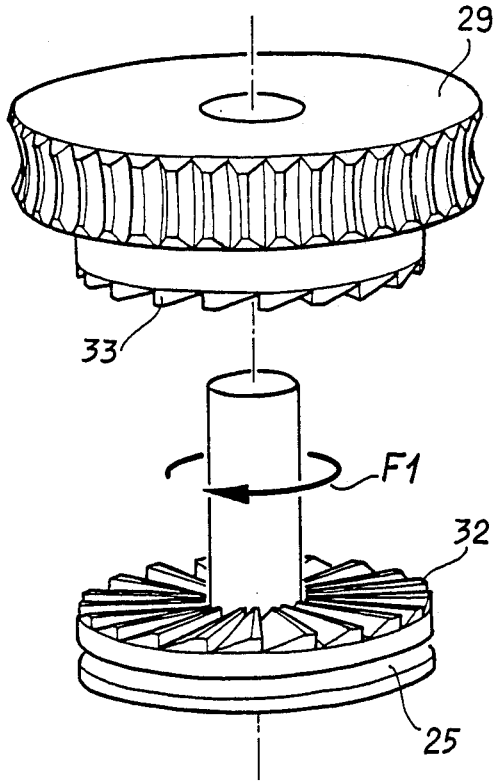
FIG. 7 shows a perspective view of two essential elements of the tensioner illustrated in FIG. 6.

The handle 37 can be driven in rotation in the winding direction of the cable 5, that is to say in the direction of the arrow Fl in FIG. 7. During this rotation, the teeth 32 of the winding drum 25 slide on the teeth 33 of the helical gear wheel 29, the winding drum 25 moving away from the gear wheel 29 and at the same time compressing the spring 34. The teeth 32 therefore jump over the teeth 33. The winding drum 25 thus rotates step by step, one step corresponding to one tooth. Because of the form and of the teeth 32 and 33, a rotation of the winding drum 25 in the other direction is impossible without driving the wheel 29. Now, the helical gear wheel 29 and the worm 30 form a non-return device, in this particular case an irreversible mechanical reducer, since the angle of the helix of the helical toothing of the wheel 29 and the corresponding angle of the helix of the worm 30 are less than 6°.

When the tension on the cable 5 becomes too high for it to be possible or simply easy to continue driving the winding drum 25 in rotation by means of the handle 27, additional tension can be obtained by rotating the knob 37 of the worm 30. The non-return device is then used as a mechanical reducer, that is to say a force multiplier.

Figure 9:
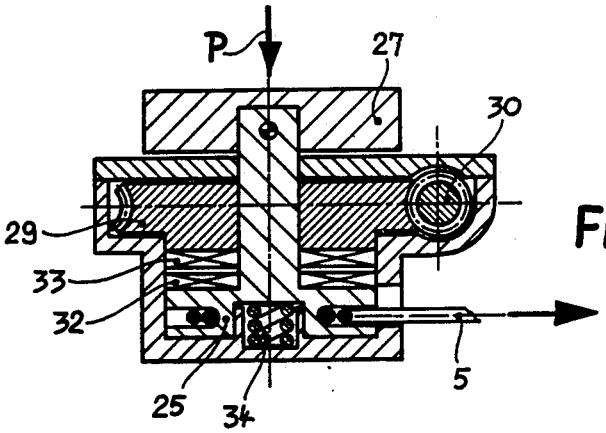
FIG. 9 is a view, similar to that of FIG. 6, in the position of release of the cable.

The instantaneous release of the cable 5 is obtained as a result of pressure P on the handle 27. The effect of this pressure P is to compress the spring 34 and free the toothings 32 and 33 from one another, as shown in FIG. 9. The winding drum 25 is consequently released from the non-return device and it can be driven freely by means of the cable 5.

Figure 10:
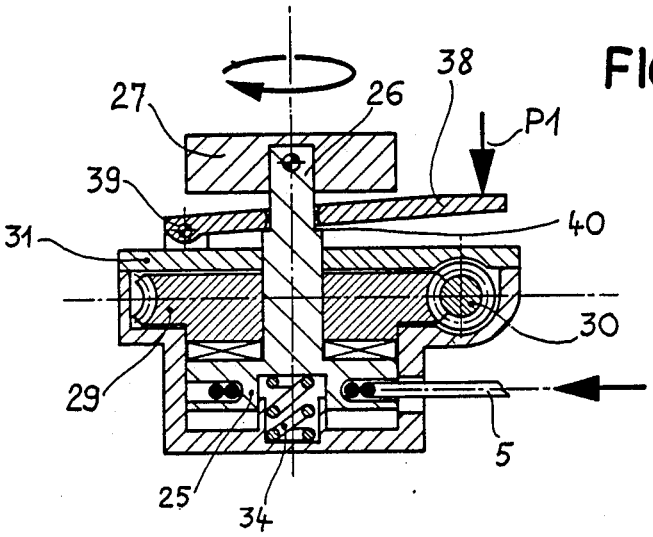
FIG. 10 is a sectional view of an alternative version of the third embodiment.

The release of the winding drum 25 can be made easier by means of an auxiliary lever. FIG. 10 shows such an alternative embodiment. An auxiliary lever 38 is pivoted on the cover 31 by means of an axle 39. The axle 26 passes through this lever 38 and has a bearing surface 40 on which the lever 38 acts when pressure Pl is exerted on its end.

The cable tensioner according to the invention can be mounted on a boot in various ways. FIG. 5 shows an example of use. The tensioner is fastened to the back of the rear half-upper 41 of a rear-fitting boot. The housing 1 is inside this cavity between the plastic of this half-upper and the padding 42 covering the inside of this half-upper. The cable 5 passes twice over a pressure distributor 43, and its other end is fastened laterally to the shell of the boot at 44.

I claim:

1. A cable tensioner with a winding drum for a ski boot, comprising, in a housing (1; 28), a winding drum (2; 25) equipped with a toothing (7; 32) a rotatable external handle (12; 27) shiftable axially counter to the action of a spring, and a non-return device (10, 13, 14; 29, 30) preventing the drum from rotating in the unwinding direction, this non-return device being cancellable as a result of pressure on the handle, wherein the cancellable non-return device is composed of a set of movable elements (10, 13, 14; 29, 30), one (10; 29) of which meshes with the toothing of the winding drum, one (10; 30) of these movable elements also being driveable in rotation by said external handle for driving the winding drum.

2. The cable tensioner as claimed in claim 1, wherein the winding drum (2) is mounted beside the axle of the handle (12), wherein the toothing of the winding drum (2) is a peripheral toothing (7), and wherein the movable element meshing with the toothing of the winding drum (2) is a pinion (10) fixed to the axle of the handle (12)

and movable axially together with this handle, this pinion (10) also being fixed to a coaxial rotary member (13) interacting with a stationary member (14) preventing it from rotating in one particular direction.

3. The cable tensioner as claimed in claim 2, wherein the rotary member (13) is formed by an extension of the axle of the pinion and is consequently movable axially together with the pinion and the handle, and wherein the spring (17) acts axially on the rotary member.

4. The cable tensioner as claimed in claim 2, wherein the said rotary member integral in terms of rotation with the axle of the pinion is mounted slideably on this axle (23), and wherein the spring (24) working under compression is arranged between the pinion and the rotary member.

5. The cable tensioner as claimed in claim 3, wherein the rotary member and the stationary member form a one-way coupling.

6. The cable tensioner as claimed in claim 4, wherein the rotary member and the stationary member form a one-way coupling.

7. The cable tensioner as claimed in claim 1, wherein the winding drum (25) is integral with the axle of the handle (27), wherein the toothing of the winding drum (25) is an edge toothing in the form of ratchet teeth (32), and wherein the movable element meshing with the toothing of the winding drum is a gear wheel (29) with a helical toothing equipped with a toothing in the form of ratchet teeth (33), meshing with the toothing of the winding drum under the action of the said spring (34), the said helical toothing meshing with a worm (30) actuable from the outside, the angle of the helix of the helical toothing being such that the worm is prevented from being driven by the helical gear wheel.

8. The cable tensioner as claimed in claim 7, which comprises an auxiliary lever (38) which passes under the handle and which bears on a bearing surface (40) of the latter for the purpose of pushing the axle of the handle axially counter to the action of the spring.

* * * * *